US006466678B1

(12) United States Patent
Killion et al.

(10) Patent No.: US 6,466,678 B1
(45) **Date of Patent: *Oct. 15, 2002**

(54) HEARING AID HAVING DIGITAL DAMPING

(75) Inventors: Mead C. Killion, Elk Grove Village, IL (US); Chris W. Papalias, Redwood City; Anthony J. Becker, San Jose, both of CA (US); Dan Mapes-Riordan, Evanston, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/542,133

(22) Filed: Apr. 4, 2000

Related U.S. Application Data

(63) Continuation-in-part of application No. 09/158,213, filed on Sep. 22, 1998, now Pat. No. 6,047,075, which is a continuation of application No. 08/346,855, filed on Nov. 30, 1994, now Pat. No. 5,812,679.

(51) Int. Cl.[7] ..... H04R 25/00

(52) U.S. Cl. ..... 381/314; 381/312; 381/320; 381/321

(58) Field of Search ..... 381/320, 321, 381/322, 324, 328, 330, 71.6, 93, 94.8, 94.2, 98, 101, 103, 316

(56) References Cited

U.S. PATENT DOCUMENTS

| | | | |
|---|---|---|---|
| 3,930,560 | A | 1/1976 | Carlson et al. |
| 4,170,720 | A | 10/1979 | Killion |
| 4,677,675 | A | 6/1987 | Killion et al. |
| 4,677,679 | A | 6/1987 | Killion |
| 4,689,819 | A | 8/1987 | Killion |
| 4,783,818 | A | 11/1988 | Graupe et al. |
| 4,845,757 | A | 7/1989 | Wagner |
| 4,985,925 | A | 1/1991 | Langberg et al. |
| 5,091,952 | A | 2/1992 | Williamson et al. |
| 5,131,046 | A | 7/1992 | Killion et al. |
| 5,259,033 | A | 11/1993 | Goodings et al. |
| 5,384,537 | A | 1/1995 | Ito et al. |
| 5,812,679 | A | 9/1998 | Killion et al. |
| 6,047,075 | A | 4/2000 | Killion et al. |

OTHER PUBLICATIONS

Mead C. Killion/William J. Murphy; "Smoothing the ITE Response: The BF–1743 Damped Coupling Assembly"; Rev. 06/82.

*Primary Examiner*—Minsun Oh Harvey
(74) *Attorney, Agent, or Firm*—McAndrews, Held & Malloy, Ltd.

(57) ABSTRACT

A hearing aid is set forth that includes one or more hearing aid components that introduce an undesired undamped peak into the frequency response of the hearing aid. An electronic damping filter is utilized to compensate for the undamped peak. The electronic damping filter has a notch filter response that includes an inverse peak across the frequency range of the undamped peak thereby electronically damping the frequency response so that the hearing aid output is generally unaffected by the undesired characteristics of the inverse peak.

The electronic damping filter may be programmable to vary the magnitude and/or shift the frequency of the inverse peak. A method is set forth that exploits this programmability and allows the same circuit topology to be used in two different hearing aids respectively having two different undamped peaks. A further method allows handling two or more peaks.

35 Claims, 19 Drawing Sheets

HEARING AID HAVING DIGITAL DAMPING

CROSS-REFERENCE TO RELATED APPLICATIONS

This application is a continuation-in-part of application Ser. No. 09/158,213 filed Sep. 22, 1998, now U.S. Pat. No. 6,047,075 which is a continuation of application Ser. No. 08/346,855 filed Nov. 30, 1994, now U.S. Pat. No. 5,812,679 issued Oct. 22, 1998.

INCORPORATION BY REFERENCE

U.S. Pat. No. 5,812,679 and U.S. application Ser. No. 09/158,213 are incorporated herein by reference in their entirety.

STATEMENT REGARDING FEDERALLY SPONSORED RESEARCH OR DEVELOPMENT

N/A

TECHNICAL FIELD

The present invention relates to an electronic hearing aid. More specifically, the present invention relates to an electronic damper for replacing the mechanical acoustic dampers used to smooth the frequency response of a hearing aid.

BACKGROUND OF THE INVENTION

Generally stated, hearing aids include a microphone for transducing detected sound, an amplifier for amplifying the electronic signals received from the microphone, and an earphone for transducing the amplified electronic signals into sound for hearing by the hearing aid wearer. The microphones and/or earphones used in such hearing aids often do not have a flat frequency response, but, rather, have a generally flat frequency response with an undamped peak across a known frequency range.

Feedback is a potential problem in such hearing aids since the output of the hearing aid must of necessity be much greater than the input and since there is often leakage of sound from the interior of the ear to the exterior of the ear proximate the microphone input. The feedback problem is exacerbated by an undamped response peak of the microphone which represents a very-high-gain condition over a narrow frequency range. In many cases, the overall gain of the hearing aid is purposely reduced at most frequencies so that the gain at the frequency of an undamped peak will not produce feedback.

A reduction in quality of delivered sound typically accompanies an undamped peak. An undamped peak can also result in user discomfort where complex sounds have an energy concentration in the vicinity of the undamped peak. Such discomfort may be eliminated by reducing the overall gain of the amplifier. This approach, however, results in a loss of gain at the quiet sound level such that the hearing aid wearer does not receive the full benefit of the hearing aid amplification.

Acoustic damping has heretofore used mechanical dampers to smooth the frequency response of microphones and earphones ("receivers") in order to smooth the overall frequency response of the hearing aid. The smooth response improves the overall performance of the hearing aid and helps prevent feedback.

In U.S. Pat. No. 3,930,560, Carlson and Mostardo described a fused-mesh mechanical damper. The damper described in that patent was subsequently made available as Knowles Electronic's BF-series dampers in 330, 680, 1000, 15000, 2200, 3300, and 4700 (cgs acoustic) Ohm values. A 1979 application note titled "Smoothing the ITE Frequency Response," and available from Knowles Electronics (Itasca, Ill.), described a "model BF-1743" damped coupling assembly incorporating that damper and designed to be mounted in the eartip of In-The-Ear (ITE) hearing aids. That damped coupling assembly provided a smooth response for the hearing aid earphone and permitted replacement of the damper when it became clogged with earwax or when a different value of damping resistance was desired. With that damped coupling assembly, a smooth hearing aid frequency response out to 16 kHz was practical.

Although mechanical damping mechanisms provide an improvement in the frequency response and performance of the hearing aids in which they are employed, such damping mechanisms are generally expensive and, further, are not entirely practical for some ears (especially in hot climates) since the damper elements tend to clog with earwax sometimes after only a few days. It is therefore desirable to have an alternative to such mechanical dampers.

SUMMARY OF THE INVENTION

A hearing aid is set forth that includes one or more hearing aid components that introduce one or more undesired undamped peaks into the frequency response of the hearing aid. One or more electronic damping filters are utilized to compensate for the undamped peak(s). Each such electronic damping filter has a notch filter response that includes an inverse peak across the frequency range of the undamped peak thereby electronically damping the frequency response so that the hearing aid output is rendered relatively free of the effects of the undesirable characteristics of the undamped peak(s).

In one embodiment of the invention, the hearing aid employs a microphone for transducing sound waves into electrical signals, an amplifier, and an earphone or "receiver" that transduces the amplified electrical signals from the amplifier into sound for the hearing aid wearer, the earphone and its coupling having a frequency response including a generally flat portion and at least one undamped peak. The undamped peak of the frequency response of the earphone occurs over a frequency range that is determined by the length of the sound outlet tube of the earphone. The microphone supplies electrical signals to an amplifier. The amplified signals are supplied to an electronic damper circuit that electronically damps the amplified output signal. The electronic damping circuit has a frequency response characterized by a generally flat portion and an inverse peak, the inverse peak occurring over a frequency range that generally corresponds to the frequency range of the undamped peak of the earphone. The resulting signal is an amplified signal that is generally unaffected by the undesirable characteristics of the undamped peak. This signal is supplied to a speaker that transduces the electrical signals into sound for the hearing aid wearer. The sound produced at the earphone corresponds to the sound received by the microphone but may have a frequency response that is modified to compensate for the type of hearing loss suffered by the intended wearer of the hearing aid. A further amplifier may be interposed between the electronic damping circuit and the earphone. Alternatively, the transduced signals from the microphone may be directly supplied to the damping circuit and the output of the damping circuit, in turn, amplified before being supplied to the earphone.

In another embodiment of the disclosed hearing aid, the electronic damping circuit is programmable to shift the frequency range and/or alter the magnitude of the inverse peak. This may be accomplished, for example, by using a low pass filter and a high pass filter. The filters may be adjusted so that their respective frequency responses overlap to provide a notch filter response, the position of the inverse peak in the frequency spectrum and the magnitude thereof being determined by the degree and location of the overlap in the low and high pass filter responses. The low pass and high pass filters may be formed as switched capacitor, Butterworth filters, the switching frequency of the filters determining the position and/or the magnitude of the inverse peak.

In a further embodiment of the hearing aid, the electronic damping circuit may be formed as an active bridged-T network circuit having a notch filter response. Programmability may be obtained by implementing the active bridged-T network circuit using virtual resistors comprised of switched capacitors wherein the frequency range and/or the magnitude of the notch response is determined by the frequency of at least one clock signal used to switch the capacitors of the filter.

In the overlapping Butterworth filter implementation and the bridged-T filters implementation of the damping circuit, programmability may be obtained by switching a plurality of capacitors in parallel to vary the capacitance values that determine the frequency characteristics of the filter.

In an even further embodiment, a digital signal processor is used to provide damping. The digital signal processor may execute low and high pass filters, and coefficients of such filters may be modified to alter the magnitude, shape and location of an inverse peak in the overall filter response. The coefficients may be modified via a user interface that communicates with the digital signal processor.

A method for producing multiple hearing aids is also set forth wherein the same electronic damping circuit topology can be used to dampen the frequency responses of two different hearing aids having different undamped frequency response characteristics. In accordance with the method, a first hearing aid is provided. The first hearing aid includes an earphone having at least one sound outlet tube to supply sound to the wearer. The earphone has a frequency response including a generally flat portion and at least one undamped peak wherein the undamped peak occurs over a frequency range that is dependent on the length of the outlet tube. A first programmable electronic damping circuit is provided for use in the first hearing aid. The programmable electronic damping circuit has a frequency response characterized by a generally flat portion and an inverse peak. The programmable electronic damping circuit is constructed using a predetermined circuit topology. The first programmable electronic damping circuit is then programmed so that the programmable frequency range of the inverse peak generally corresponds to the frequency range of the undamped peak to provide a hearing aid output signal that is generally unaffected by the undesirable characteristics of the undamped peak of the first hearing aid.

A second hearing aid is then provided. The second hearing aid includes an earphone having a frequency response including a generally flat portion and at least one undamped peak wherein the undamped peak occurs over a frequency range that is different from the frequency range of the undamped peak of the earphone of the first hearing aid.

A second programmable electronic damping circuit having the same circuit topology as the first programmable electronic damping circuit is then provided. The second electronic damper is programmed so that the programmable frequency range of the inverse peak generally corresponds to the frequency range of the undamped peak of the earphone of the second hearing aid. This results in a hearing aid output signal from the hearing aid that is generally unaffected by the undesirable characteristics of the inverse peak of the microphone of the second hearing aid.

Other objects and advantages of the present invention will become apparent upon reference to the accompanying detailed description when taken in conjunction with the following drawings.

DETAILED DESCRIPTION OF THE INVENTION

Figure 1:
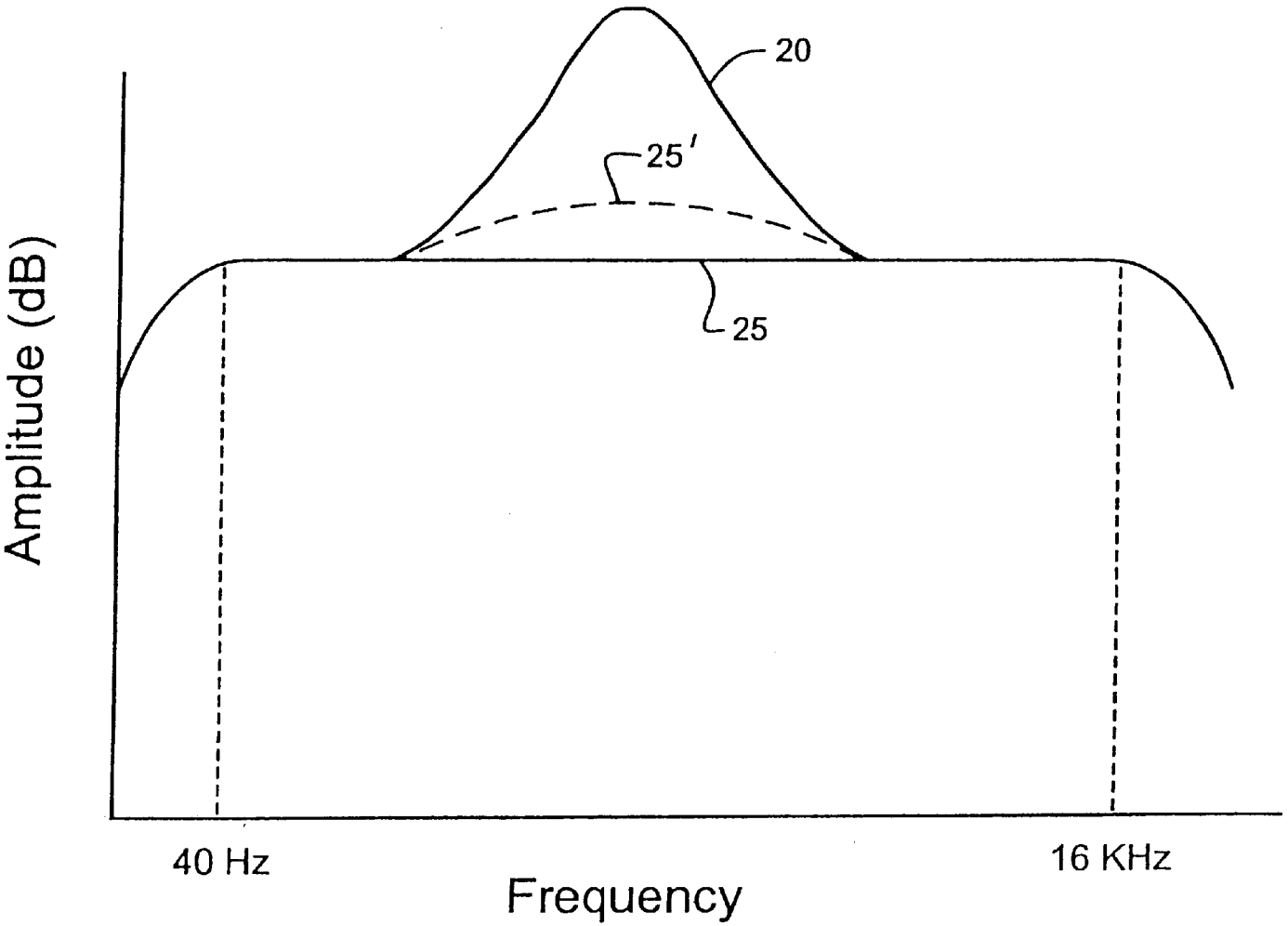
FIG. 1 is a graph of amplitude versus frequency of an undamped hearing aid earphone and the desired frequency response of the earphone.

FIG. 1 is a graph of amplitude versus frequency illustrating an undamped frequency response 20 of a hearing aid microphone and the desired alternative frequency responses 25 and 25'. As illustrated, the undamped response 20 is generally flat and coincides with the desired responses except that it includes an undamped peak across a known frequency range. The desired frequency response curve 25 is generally flat across the entire audible frequency range, shown here as being between 40 Hz and 16 kHz. The alternate desired frequency response 25' represents an attenuation of the undamped peak 20 to provide a frequency response that, for example, corresponds to the natural frequency response of the ear of the hearing aid wearer.

Figure 2A:
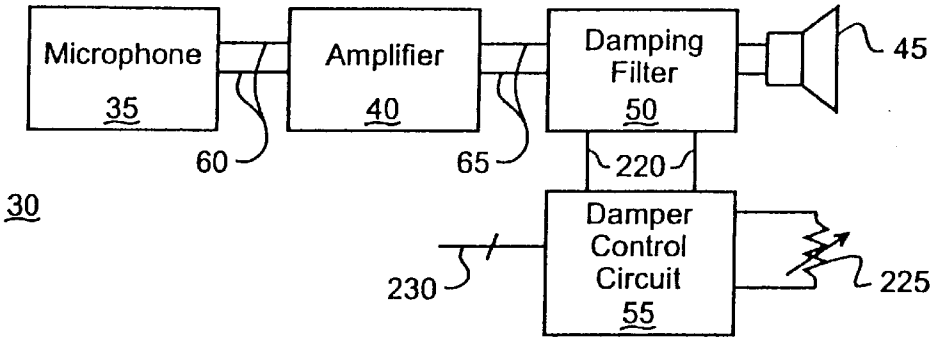
FIG. 2A is a block diagram of one embodiment of a hearing aid incorporating an electronic damping filter.
Figure 2B:
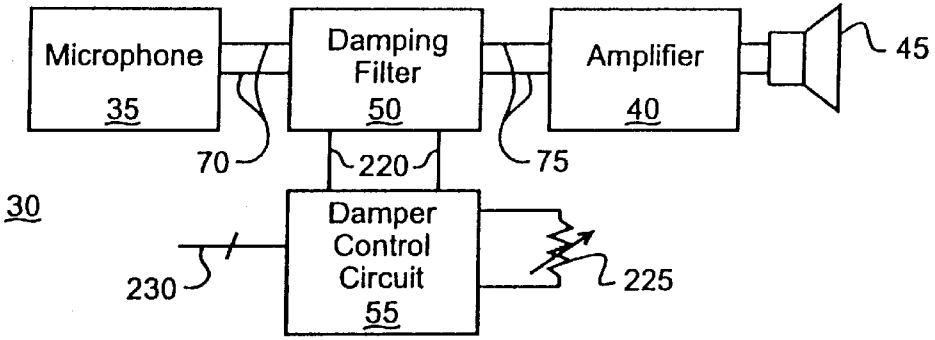
FIG. 2B is a block diagram of another embodiment of a hearing aid incorporating an electronic damping filter.
Figure 2C:
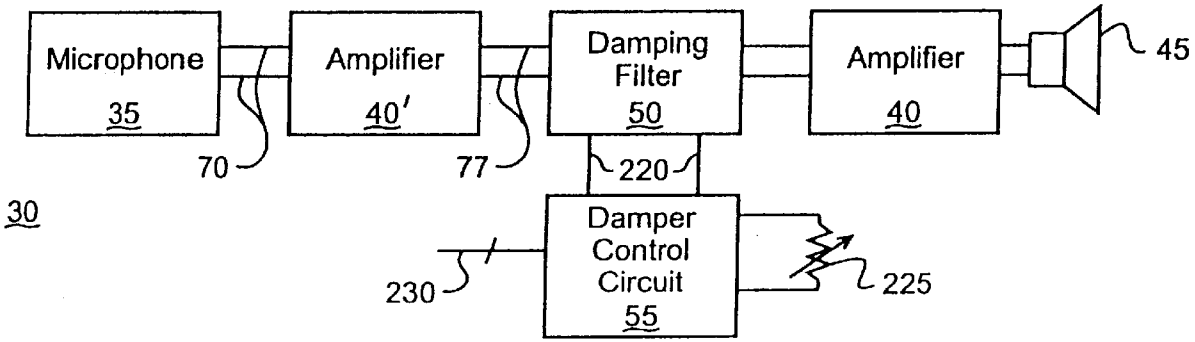
FIG. 2C is a block diagram of a further embodiment of a hearing aid incorporating an electronic damping filter.

FIGS. 2A–2C show three different block diagrams of a hearing aid in accordance with the teachings of the present invention. In the embodiments of FIGS. 2A and 2B, the hearing aid circuits, shown generally at 30, include a microphone 35, an amplifier 40, and an earphone 45. A damping filter 50 is interposed between the amplifier 40 and the earphone 45 of the embodiment shown in FIG. 2A. The block diagram of FIG. 2B illustrates the placement of the damping filter 50 between the microphone 35 and the amplifier 40. The embodiment of FIG. 2C includes a further amplifier 40' that may, for example, function as a preamplifier. In each of the illustrated embodiments, the frequency response of the damping filter 50 is programmable and may be adjusted, for example, through a damper control circuit 55. In each of these embodiments, the hearing aid components may be disposed within a single housing.

In the operation of the hearing aid of FIG. 2A, the microphone 35 detects sound from the exterior of the hearing aid and transduces that sound to produce electronic signals along one or more lines 60 to the amplifier 40. The amplifier 40 amplifies these electronic signals to produce amplified electronic signals along one or more of lines 65. The amplifier 40 may be constructed, for example, in accordance with the teachings of U.S. Pat. Nos. 4,170,720 or 4,689,819 which are hereby incorporated by reference. Other amplifier circuits will also be sufficient to practice the present invention.

The operation of the hearing aid of FIG. 2B is similar except that the damping is performed on the microphone output signal before amplification since the damping filter 50 is interposed between the microphone 35 and the amplifier 40. The electrical signals from the microphone 35 are thus transmitted along one or more lines 70 to the damping filter 50. The output of the damping filter is supplied, in turn, to the input of amplifier 40 along one or more of lines 75.

The operation of the embodiment of FIG. 2C is likewise similar to the operation of the FIG. 2B embodiment except that the signals from the output of microphone 35 are transmitted along lines 70 for amplification by amplifier 40'. These signals are amplified and supplied to the damping filter 50 along one or more lines 77.

Figure 3:
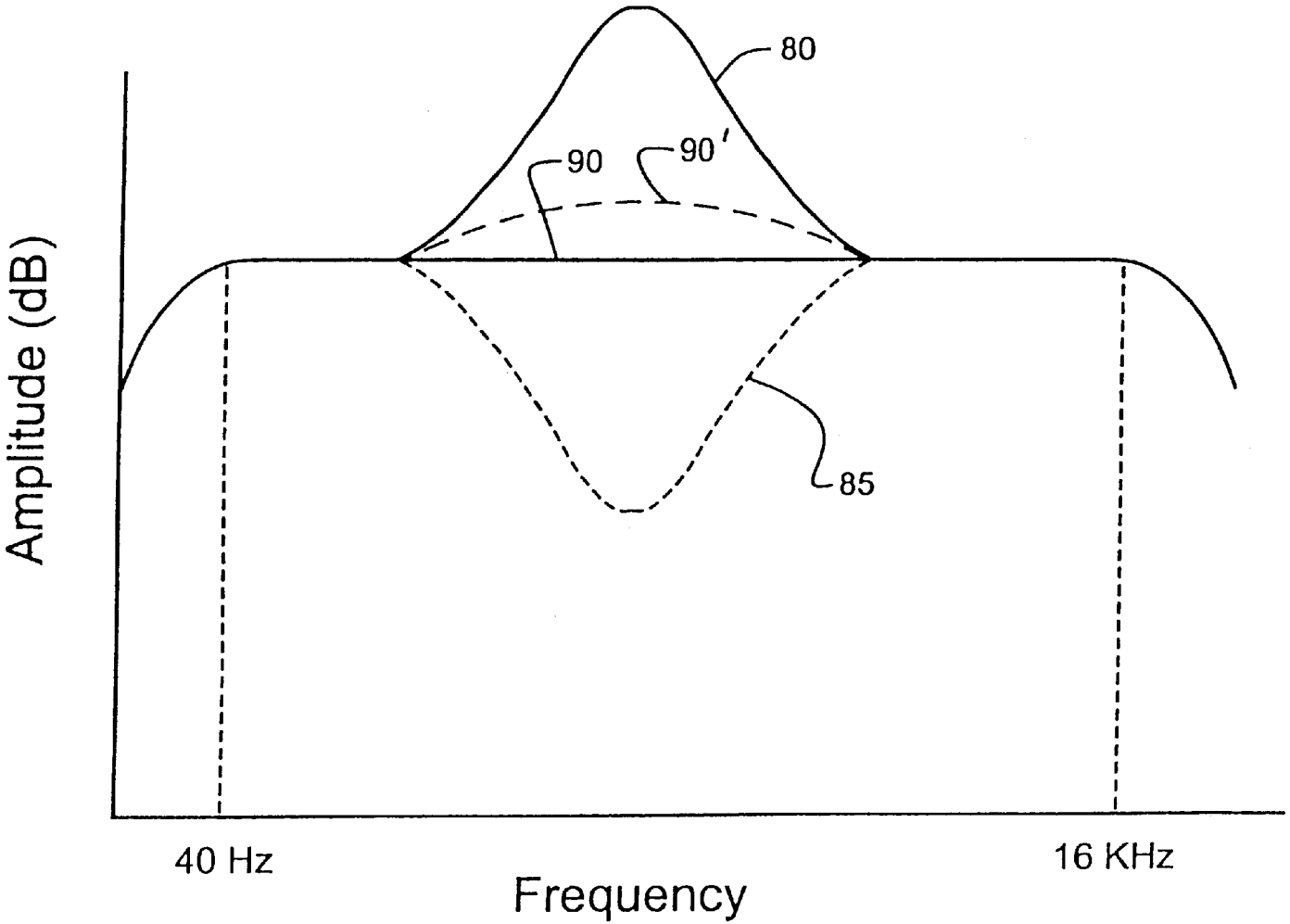
FIG. 3 is a graph of amplitude versus frequency of an undamped hearing aid earphone, a damping filter, and the resulting damped response.

The frequency response of the earphone 45 is shown in FIG. 3 as line 80. As illustrated, the frequency response is generally flat but includes at least one undamped peak across a frequency range within the audible hearing range. Since it is more desirable for the earphone to have a generally flat frequency response across the entire audible hearing range or at least have the undamped peak attenuated, the hearing aid circuits of FIGS. 2A–2C each employ the damping filter 50. The damping filter 50 has a notch filter response as illustrated by line 85 in the graph of FIG. 3. This notch response is characterized by a generally flat portion corresponding to the generally flat portion of the undamped response 80 and further includes an inverse peak occurring over a frequency range that generally corresponds to the frequency range of the undamped peak. The magnitude of the inverse peak is selected so that the inverse peak and the undamped peak completely cancel one another thereby producing a generally flat response, shown as line 90, across the frequency range of the undamped peak. Alternatively, the magnitude and/or shape of the inverse peak may be selected to only partially cancel the undamped peak, in which case, the shape and/or magnitude of the inverse peak is altered and/or attenuated in the exemplary manner indicated by the line 90'. This latter approach may be desirable in instances where the frequency response of the earphone is to generally correspond with the natural frequency response of the ear of the hearing aid wearer. The damping filter 50 thus compensates for the undamped peak and reduces or cancels the effect of the undesired characteristics of the undamped peak on the sound that is ultimately produced at the earphone 45.

Those of ordinary skill in the art will recognize that the frequency response of the hearing aid output to the earphone may not necessarily be flat. Instead, the overall response may be designed to match the needs of a selected group of hearing aid wearers. For example, hearing aids that are designed for those persons who have a hearing loss at high frequencies may have a frequency response wherein the amplitude response at the higher frequencies is greater than the amplitude response at the lower frequencies. Similarly, hearing aids that are designed for those persons who have a hearing loss at lower frequencies may have a frequency response wherein the amplitude response at the lower frequencies is greater than the amplitude response at higher frequencies. In such instances, the damping filter 50 compensates for the undamped peak so that only the desired frequency response is dominant.

Persons of ordinary skill in the art will also recognize that the microphone 35 of FIGS. 2 and 3 may have a frequency response that includes an undamped peak. Accordingly, the frequency response shown as line 80 in FIG. 3 may likewise, or alternatively, represent the frequency response of the hearing aid microphone, in which case the damping filter 50 provides compensation for the undamped peak of the hearing aid microphone 45. In instances where both the earphone 45 and microphone 35 each include an undamped peak or, alternatively, where one of these components includes more than one undamped peak, the damping filter 50 may be designed to include an inverse peak for each undamped peak.

Figure 4:
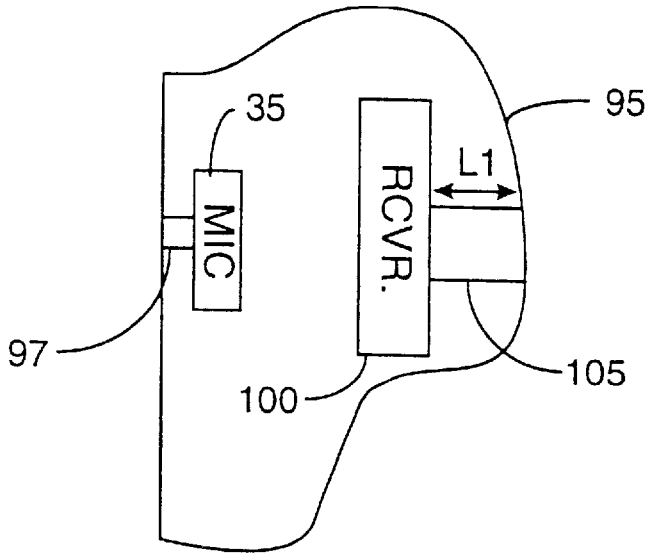
FIG. 4 is a cross-sectional view of a hearing aid that illustrates some of the mechanical aspects of a hearing aid that employs an earphone having a sound outlet tube of a relatively short length.
Figure 5:
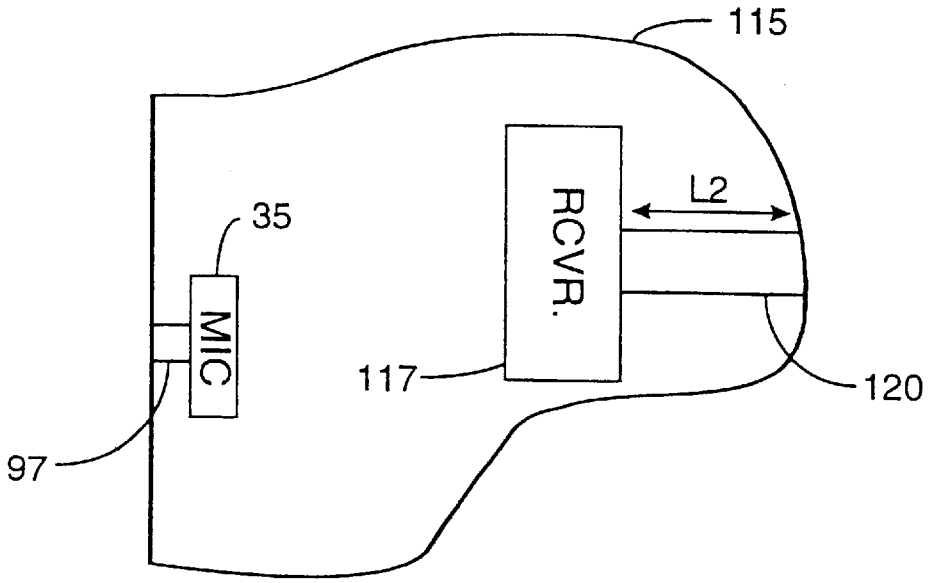
FIG. 5 is a cross-sectional view of a hearing aid that illustrates of some of the mechanical aspects of a hearing aid that employs an earphone having a sound outlet tube of a length that is greater than the length of the sound outlet tube shown in FIG. 4.

FIGS. 4 and 5 illustrate some of the mechanical aspects of two different hearing aid constructions. The hearing aid of FIG. 4 includes a housing 95 that is molded to conform to the ear of the wearer. An earphone 100 is disposed in the interior of the housing 95. The earphone 100 includes a sound outlet tube 105 that extends with a length L1 from the microphone 100 to hearing aid housing 95 to transmit sound to the exterior of the housing 95. The length L1 of the sound outlet tube 105 and the associate internal acoustical compliance and configuration of the earphone 100 contribute to the characteristics of the undamped peak illustrated in FIG. 3.

The hearing aid of FIG. 5 likewise includes a housing 115 that is molded to conform to the ear of the wearer. In this instance, however, the housing 115 is of a different size and/or shape than the housing 95 of the hearing aid of FIG. 4. Accordingly, the earphone 117 uses a sound outlet tube 120 that has a length L2 that is longer than the length L1 of the sound outlet tube 105. As a result, the undamped peak of earphone 117 occurs across a lower frequency range than the undamped peak of earphone 100 given use of the same earphone type.

Figure 6:
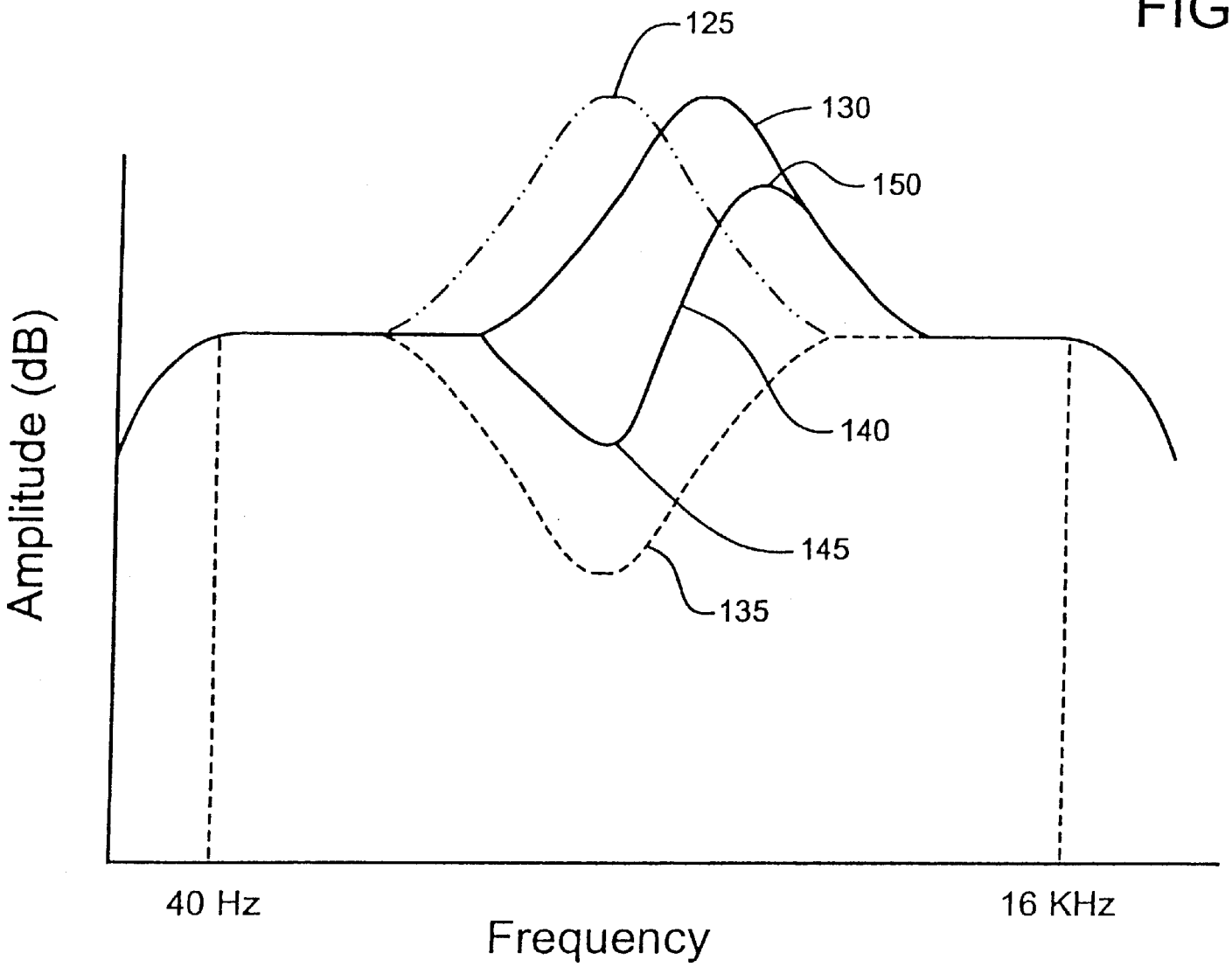
FIG. 6 is a graph of amplitude versus frequency illustrating the effect of using a damping filter having a fixed damping response in two different hearing aids employing two different earphones having different characteristics.

The difference in earphone frequency responses is illustrated in FIG. 6 where line 125 represents the frequency response of earphone 117 and line 130 represents the frequency response of earphone 100. The notch response of the damping filter used in the hearing aid of FIG. 5 is shown as line 135. While this notch response may sufficiently compensate for the undamped peak of earphone 117 it will not ideally provide damping of the undamped peak of earphone 100. If the notch response is used to compensate for the undamped peak of earphone 117, the resulting frequency response will be characterized by the response shown by line 140. As illustrated, the response 140 is characterized by a trough 145 and a peak 150 that will result in a gain below the norm in the region of the trough and gain above the norm in the region of the peak. The resulting frequency response is not desirable.

To compensate for the fact that different hearing aid constructions may use different earphones (or microphones) having undamped peaks over different frequency ranges, the damping filter 50 may be programmable. One example of a specific programmable filter construction is illustrated in FIGS. 7A and 7B.

Figure 7A:
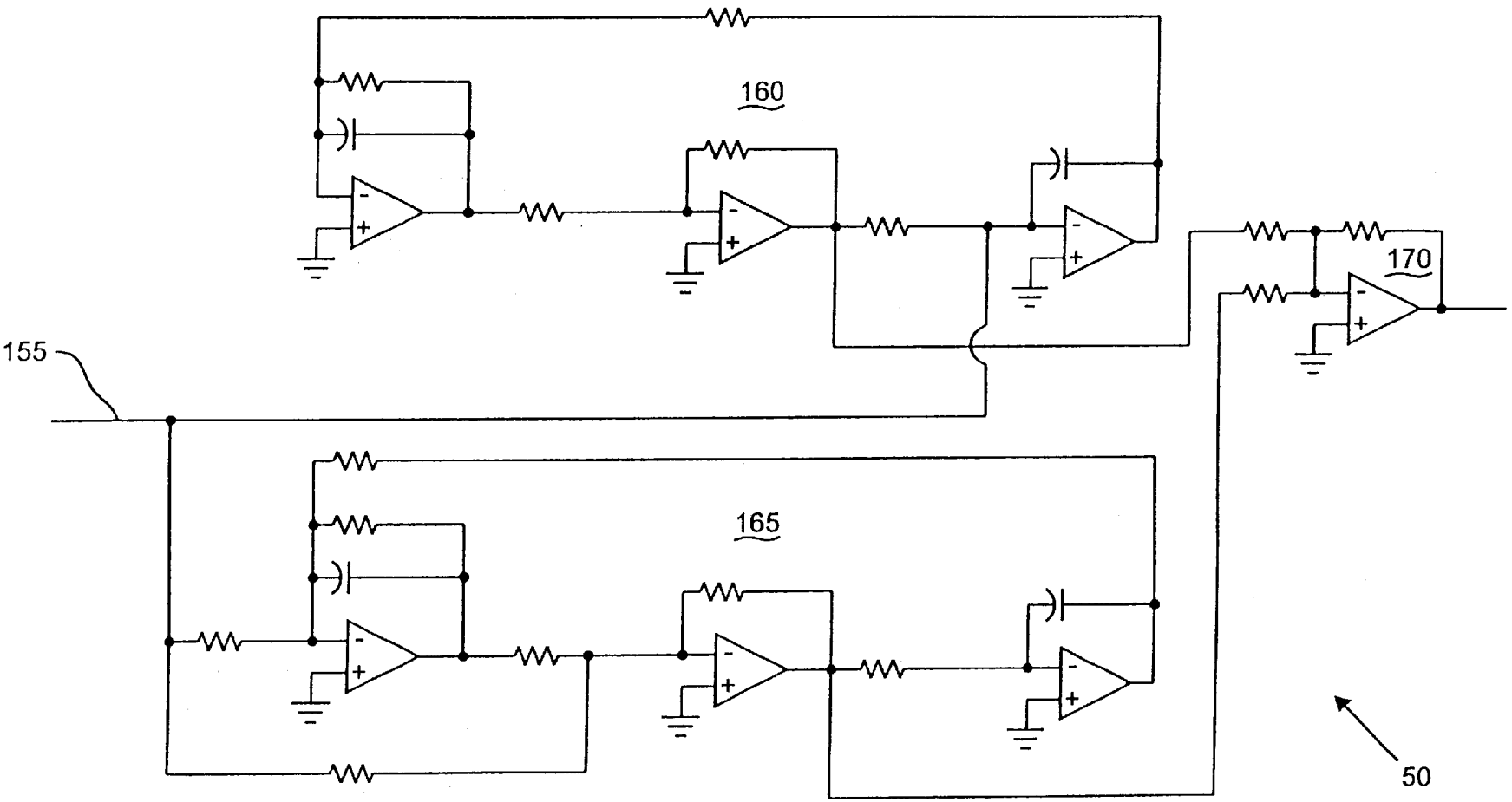
FIG. 7A is a schematic diagram of one implementation of an electronic damping filter.
Figure 7B:
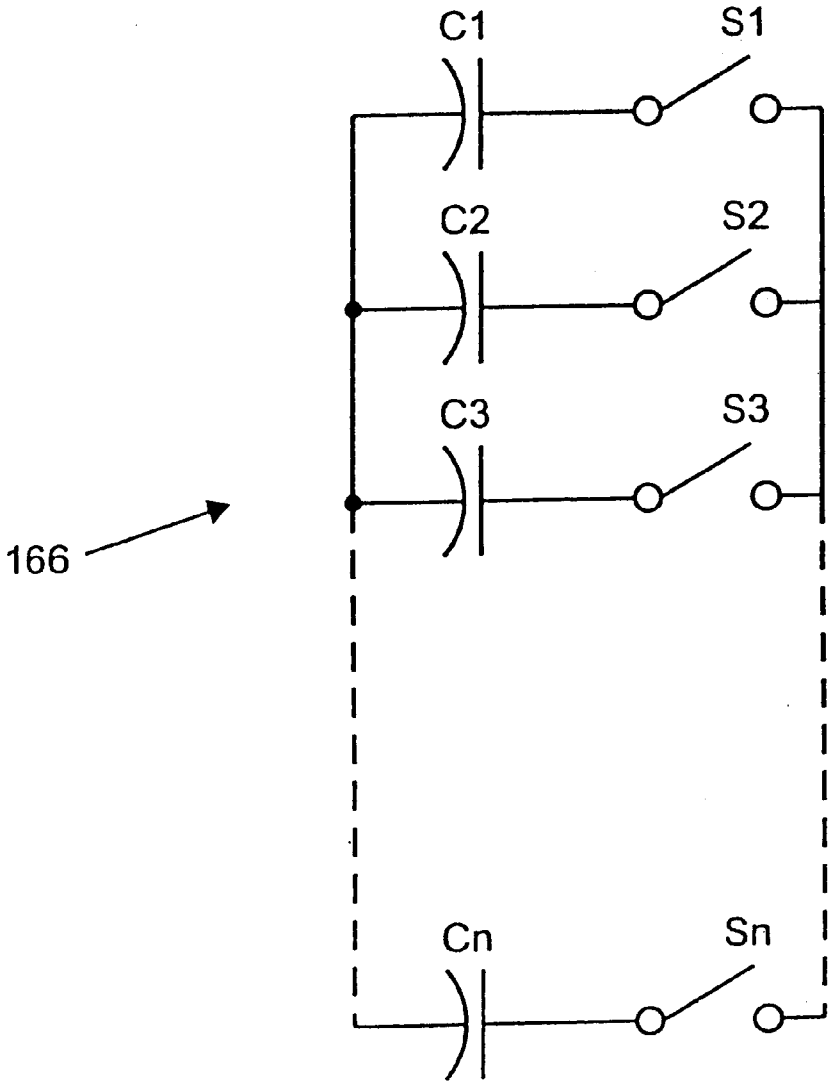
FIG. 7B illustrates a parallel capacitor bank that may be used in lieu of a single fixed capacitor to allow programmability of the damping circuit.

The filter construction of FIG. 7A includes a signal input line 155 that receives the signal that is to be damped. The signal at input line 155 is provided to a low pass Butterworth filter section 160 and a high pass Butterworth filter section 165. The output signals from each of the filter sections 160 and 165 are supplied to the input of a summing amplifier section 170.

Figure 8:
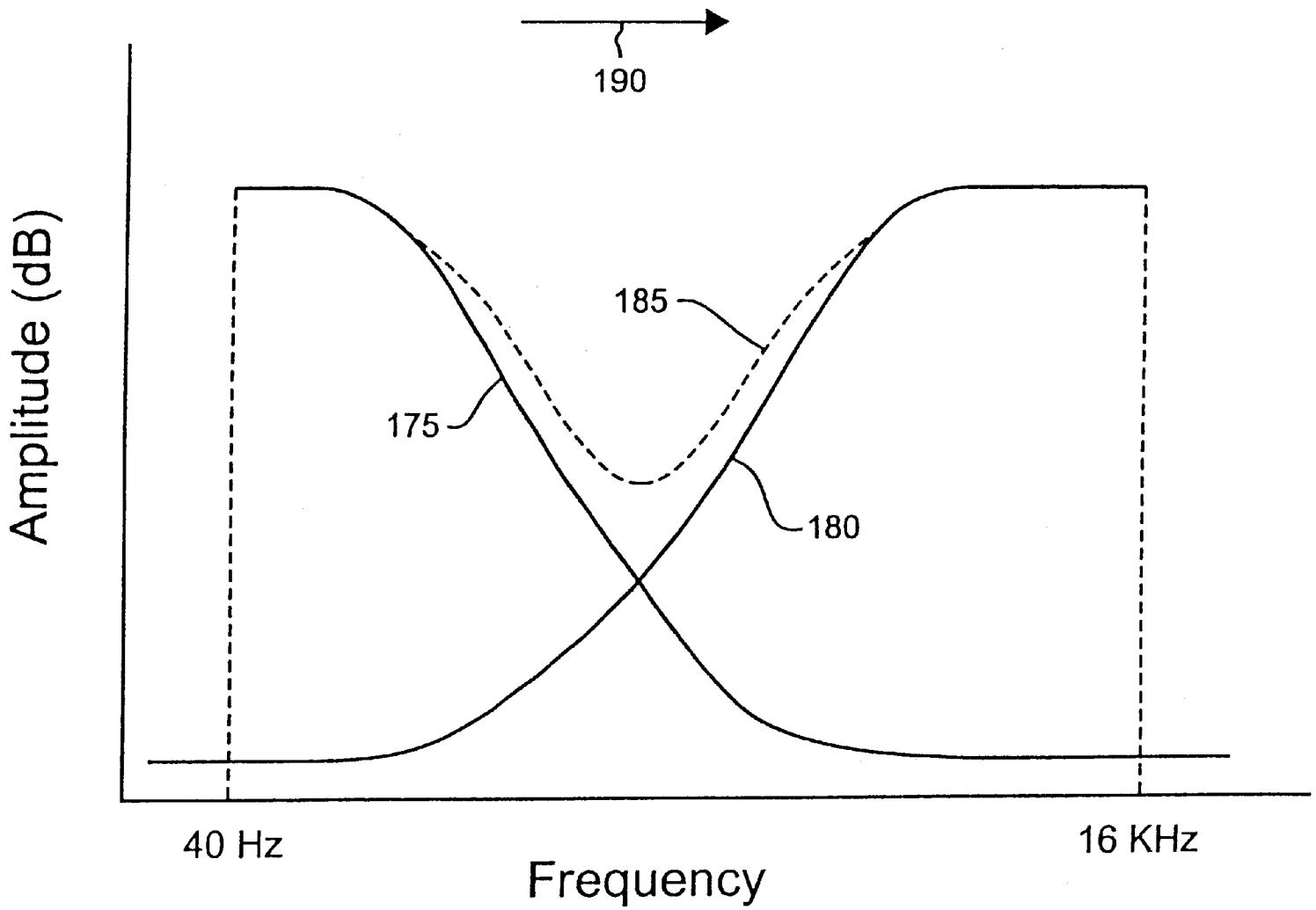
FIG. 8 is a graph of amplitude versus frequency illustrating the frequency response of the filter sections employed in the electronic damping filter of FIG. 7.

The frequency response of each of the filter sections 160 and 165 is illustrated in FIG. 8. Line 175 represents the frequency response of the low pass Butterworth filter section 160 while line 180 represents the frequency response of the high pass Butterworth filter section 165. When these responses are summed in the summing amplifier section 170 the resulting frequency response is the notch response shown by line 185.

One or more of the resistors of filter sections 160 and 165 can be variable resistors. Additionally, or alternatively, one or more of the capacitors of filter sections 160, 165 may be replaced by a parallel capacitor bank, such as illustrated in FIG. 7B. The parallel capacitor bank 166 includes a plurality of capacitors C1–Cn. Each capacitor C1–Cn is connected in series to a respective switch S1–Sn. The switches S1–Sn may, for example, be MOSFETs that are controlled by the damper control circuit 55 of FIGS. 2A–2C to selectively connect the capacitors C1–Cn in parallel to set the effective capacitance of the capacitor bank.

The relative positions of the frequency responses 175 and 180 shown in FIG. 8 may be shifted by varying the value of the variable resistors and/or capacitor bank. By shifting the relative position of these responses, the position and magnitude of the notch response 185 may be altered thereby rendering the damping filter 50 programmable to compensate for any number of microphone (or earphone) responses. For example, the low pass filter response 175 may be shifted in the direction of arrow 190 while leaving the high pass response 180 unaltered. This action would increase the degree of overlap with the high pass filter response 180 and also shift the position of the notch response 185 toward a higher frequency range. Since a higher degree of overlap of the responses would result, the magnitude of the notch response 185 would decrease. If the low pass filter response 175 is shifted in the direction of arrow 190 and the high pass frequency response 180 is likewise shifted in the same direction by an equal amount, the magnitude of the notch response 185 would remain unaltered but the inverse peak would occur over a higher frequency range.

The damping filter 50 of FIGS. 7A and 7B may be implemented on a semiconductor substrate using a switched capacitor filter configuration that utilizes virtual resistors implemented by switched capacitors as opposed to actual resistive elements. By using a switched capacitor configuration, the damping filter 50 may be formed from the same substrate as, for example, the amplifier section 40 of the hearing aid without using a significant amount of additional substrate space. The frequency response of the resulting damping filter may also be easily reprogrammed by altering the switching frequency of one or more of the switching clock signals that control the switched capacitors.

Figure 9:
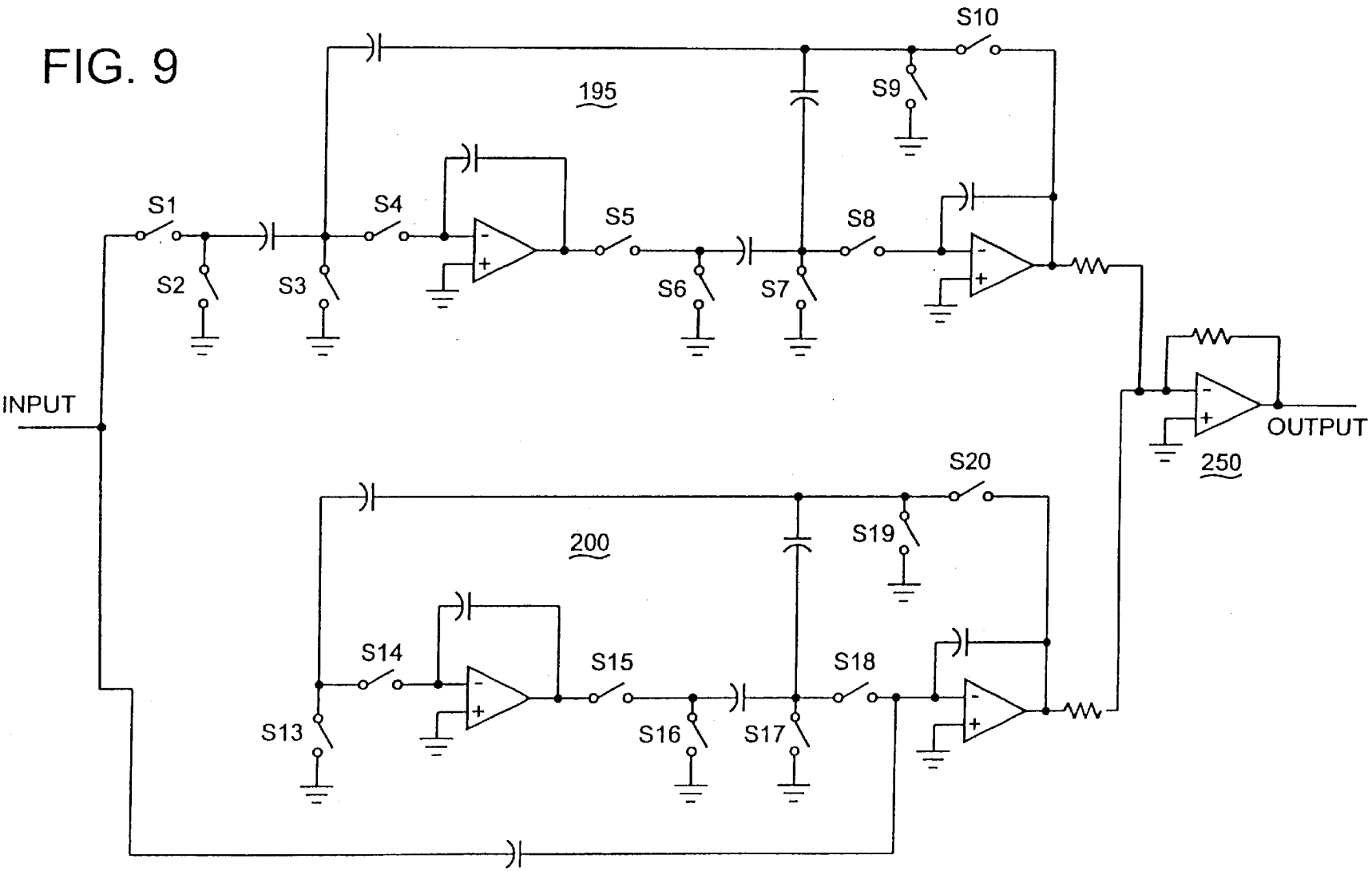
FIG. 9 is a switched capacitor implementation of the circuit of FIG. 7.
Figure 10:
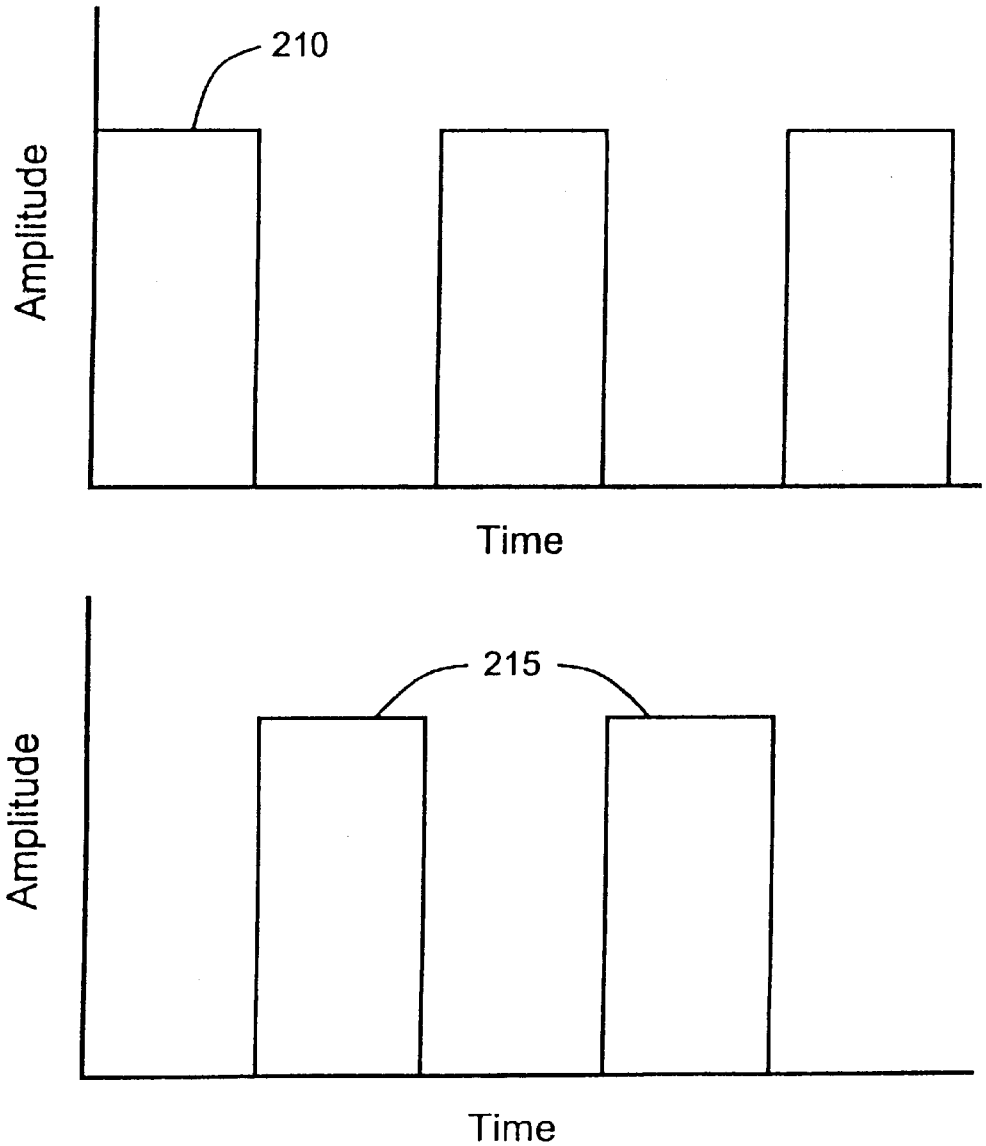
FIG. 10 illustrates the switching clock phases supplied to the switches of the circuit of FIG. 9.

Such a switched capacitor filter configuration is illustrated in FIG. 9. The filter includes a low pass Butterworth filter section 195, a high pass Butterworth filter section 200, and a summing amplifier section 250. Although the circuit is shown with mechanical switching elements, those of ordinary skill in the art will recognize that switches S1–S20 may be implemented with MOSFETs or the like that are easily manufactured in a semiconductor substrate. Switches S2, S3, S5, S7, S9, S13, S15, S17, and S19 are connected to a first switching clock phase while switches S1, S4, S6, S8, S10, S14, S16, S18, and S20 are connected to a second switching clock phase. The first and second switching clock phases are illustrated in FIG. 10 and are designated 210 and 215 respectively.

With reference again to FIGS. 2 and 3, the first and second switching clock phases 210 and 215 may be supplied to the damping filter 50 by a damper control circuit 55 along one or more of lines 220. The frequency of the switching clock phases 210 and 215 may be adjusted, for example, through the use of a variable resistor 225 or, alternatively, through a digital interface bus 230 through which digital data is sent to instruct the damper control circuit 55 to output the desired switching clock signals. Additionally, or alternatively, control signals along one or more of lines 220 may be used to control the switches of a parallel capacitor bank. In this latter instance, for example, the switching frequency of the clock phases may be constant.

Figure 11:
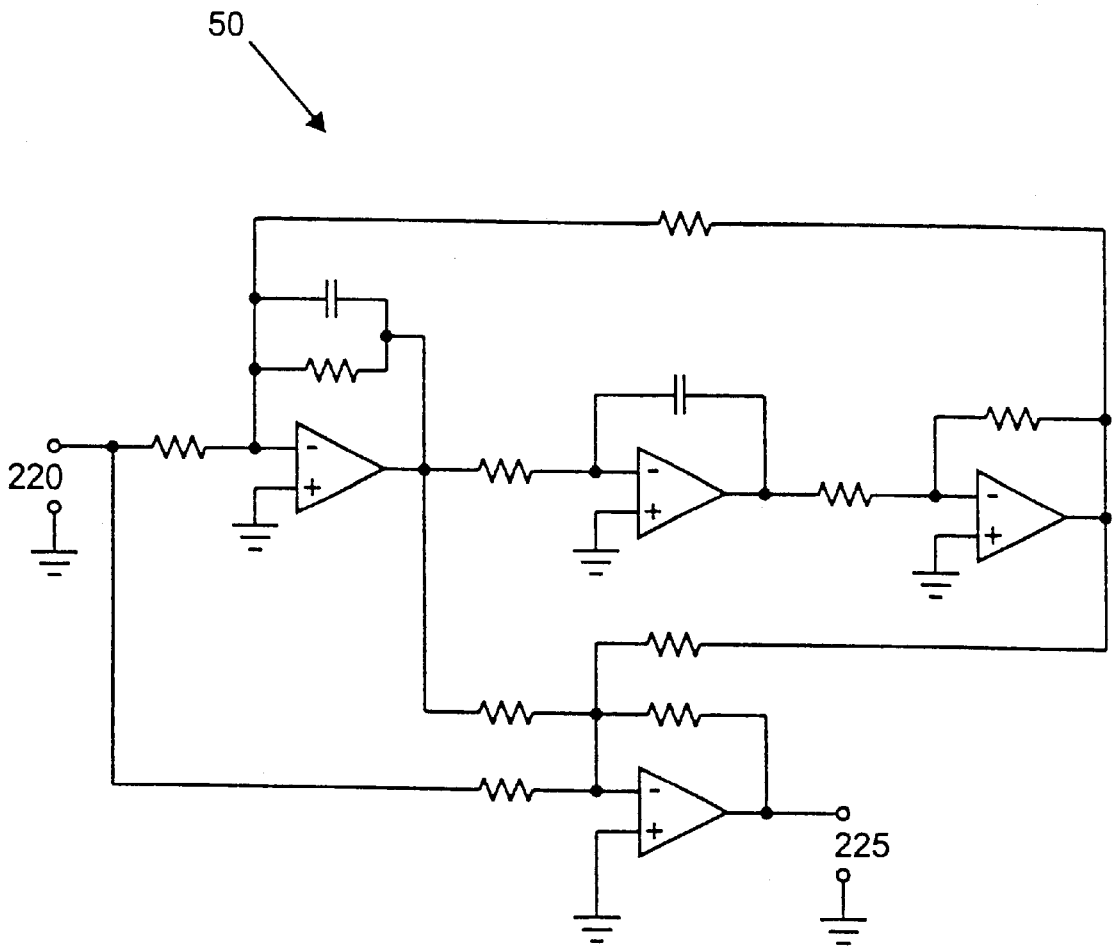
FIG. 11 is a schematic diagram of a biquad filter that may be used as the damping filter of the hearing aid illustrated in FIGS. 2 and 3.

Another damping filter circuit construction is illustrated in FIG. 11. In this example of the damping filter construction, the damping filter circuit 50 is of a biquad notch filter topology. The signal that is to be damped is supplied at input 220. The resulting damped signal is output from the filter 50 at output 225. Those of ordinary skill in the art will recognize that one or more resistors of the circuit may be variable resistors and that one or more capacitors may be parallel capacitor banks. The values of the resistors and/or capacitor banks may be adjusted to vary the frequency at which the inverse peak occurs and the Q factor of the filter response.

Figure 12:
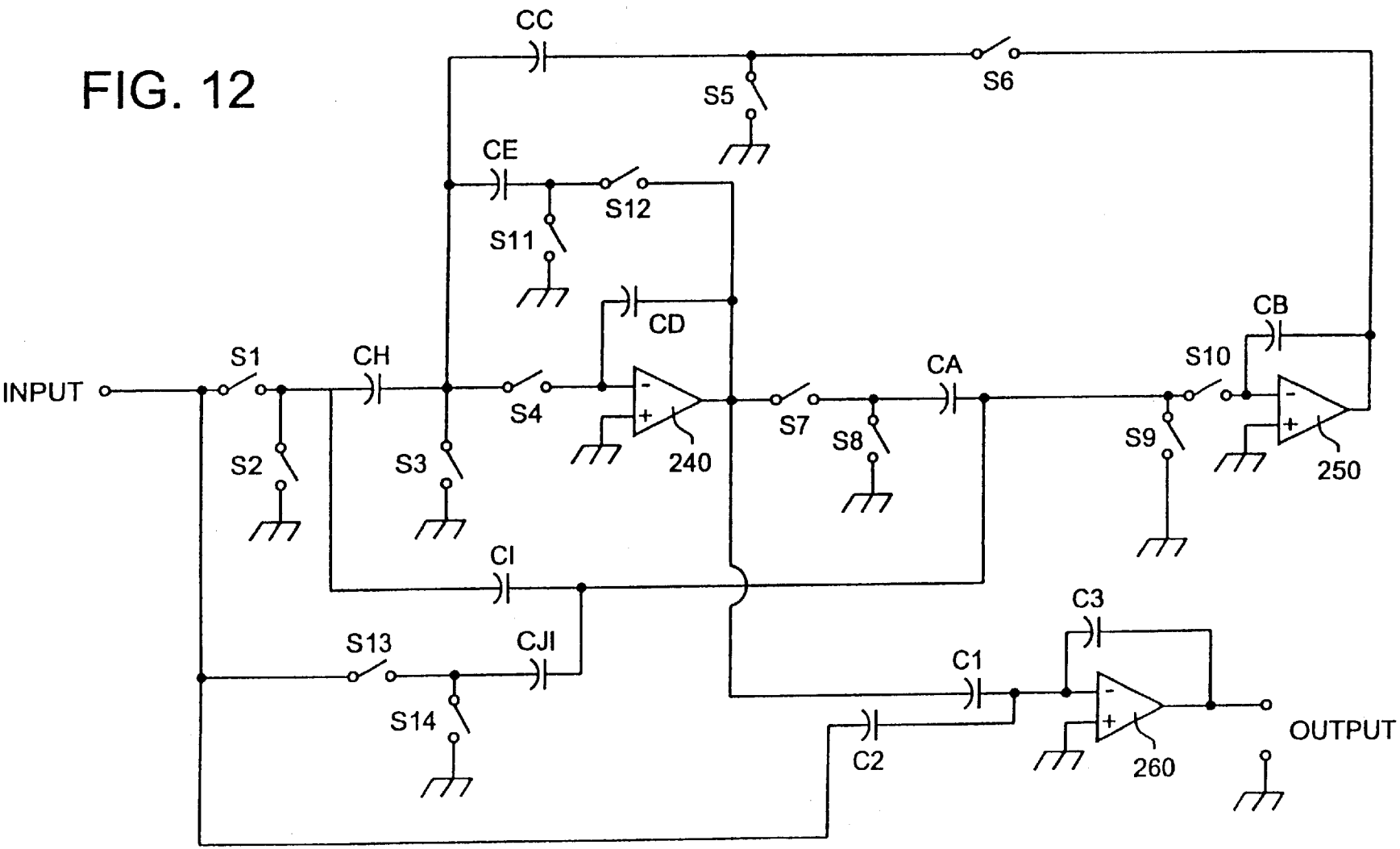
FIG. 12 is a schematic diagram of an active bridged-T circuit implemented with switched capacitors and that may be used as the damping filter of the hearing aid illustrated in FIGS. 2A–2C.

In a unique and heretofore unknown alternative circuit topology, the damper filter circuit has been implemented as an active bridge-T circuit in a switched capacitor configuration. This switched circuit configuration is shown in FIG. 12 and is implemented using only three operational amplifiers 240, 250, and 260. As noted with respect to the filter circuit of FIG. 9, switches S1–S14 may be implemented using MOSFETs. Switches S1, S6, S8, S10, S12, and S14 are supplied with a first switching clock phase signal while switches S2–S5, S7, S9, S11 and S13 are supplied with a second switching clock phase signal. The position of the inverse peak in the frequency response of the filter may be adjusted by varying the frequency of at least one of the switching clock phase signals. Additionally, or alternatively, the position and/or Q may be adjusted by means readily apparent to those skilled in the art.

The programmability of the frequency response of the damping filter may be used to produce multiple hearing aids that have, for example, different earphones (or microphones) with different undamped peaks while still maintaining the same filter circuit topology. By using the same filter circuit topology, it becomes feasible to implement any number of different mechanical hearing aid designs using the same basic electronic hearing aid circuit design. This is in contrast to the range of different mechanical design constraints imposed through the use of mechanical dampers.

In accordance with this method a first hearing aid, such as the one shown generally in FIG. 4, is provided. The first hearing aid includes an earphone 100 having at least one sound outlet tube 105 to receive sound. The earphone 100 has a frequency response including a generally flat portion and at least one undamped peak wherein the undamped peak occurs over a frequency range that is dependent on the length of the outlet tube and the mechanical characteristics of the earphone. A first programmable electronic damping circuit is provided for use in the first hearing aid. The programmable electronic damping circuit has a frequency response characterized by a generally flat portion and an inverse peak. The programmable electronic damping circuit is constructed using a predetermined circuit topology. The first programmable electronic damping circuit is then programmed so that the programmable frequency range of the inverse peak generally corresponds to the frequency range of the undamped peak to provide a hearing aid output signal that is generally unaffected by the undesired characteristics of the undamped peak.

A second hearing aid, such as the one shown generally in FIG. 5, is subsequently provided. The second hearing aid includes an earphone 117 having a frequency response including a generally flat portion and at least one undamped peak wherein the undamped peak occurs over a frequency range that is different from the frequency range of the undamped peak of the earphone 100 of the first hearing aid.

A second programmable electronic damping circuit having the same circuit topology as the first programmable electronic damping circuit is then provided for use in the second hearing aid. The second electronic damping circuit is then programmed so that the programmable frequency range of the inverse peak generally corresponds to the frequency range of the undamped peak of the earphone of the second hearing aid. This results in a hearing aid output signal from the second hearing aid that is generally unaffected by the inverse peak of the microphone of the second hearing aid.

Figure 13A:
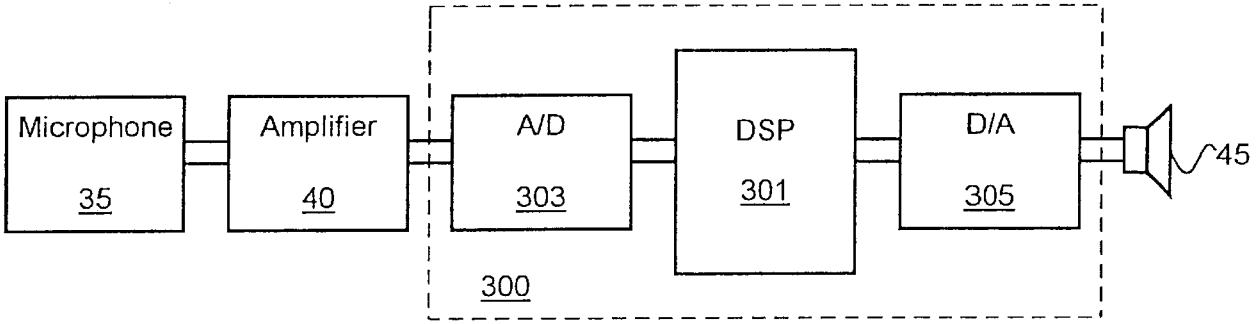
FIGS. 13A–13E illustrate five different block diagram embodiments of a hearing aid according to the present invention.
Figure 13B:
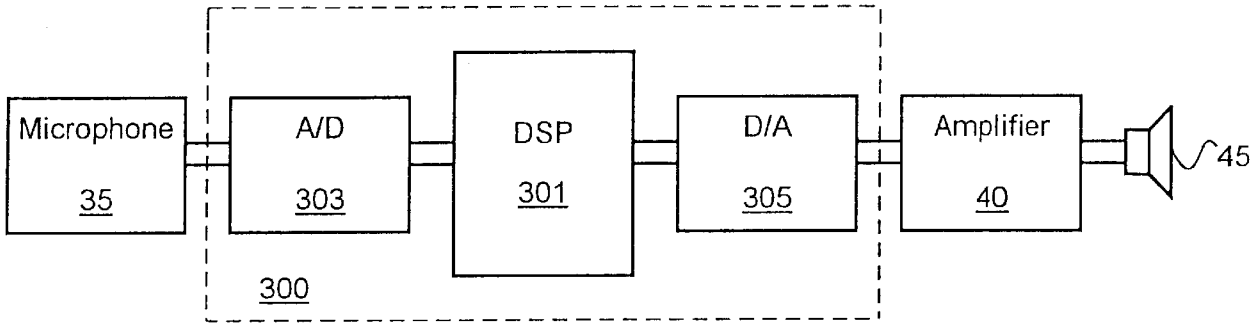
Figure 13C:
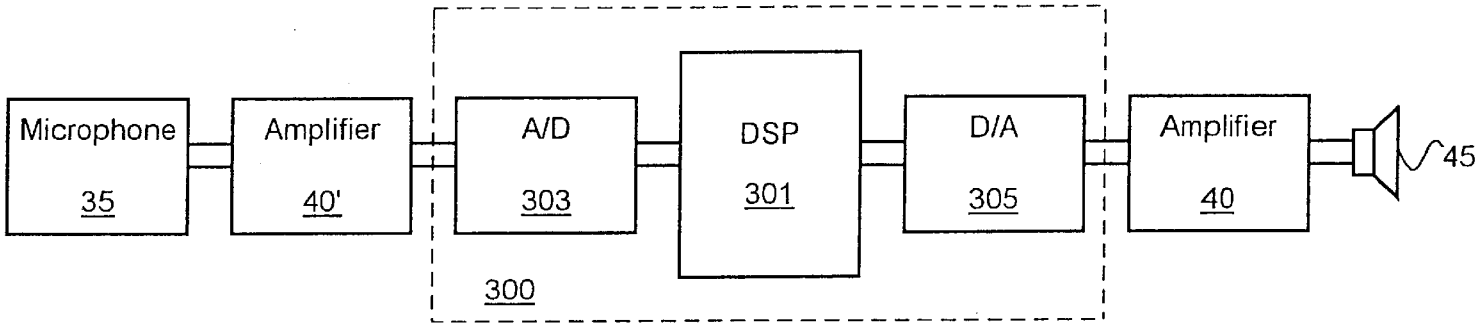

FIGS. 13A–13E illustrate five different block diagram embodiments of a hearing aid according to the present invention. FIGS. 13A–13C are similar to the block diagrams of FIGS. 2A–2C, except that the damping filter 50 and damper control circuit 55 of FIGS. 2A–2C are replaced by the components found in a processing block 300 of FIGS. 13A–13C. Processing block 300 comprises, for example, a digital signal processor (DSP) 301, an analog to digital (A/D) converter 303, and a digital to analog (D/A) converter 305. The DSP 301 may be a microprocessor, such as, for example, a Motorola DSP 56303.

Figure 13D:
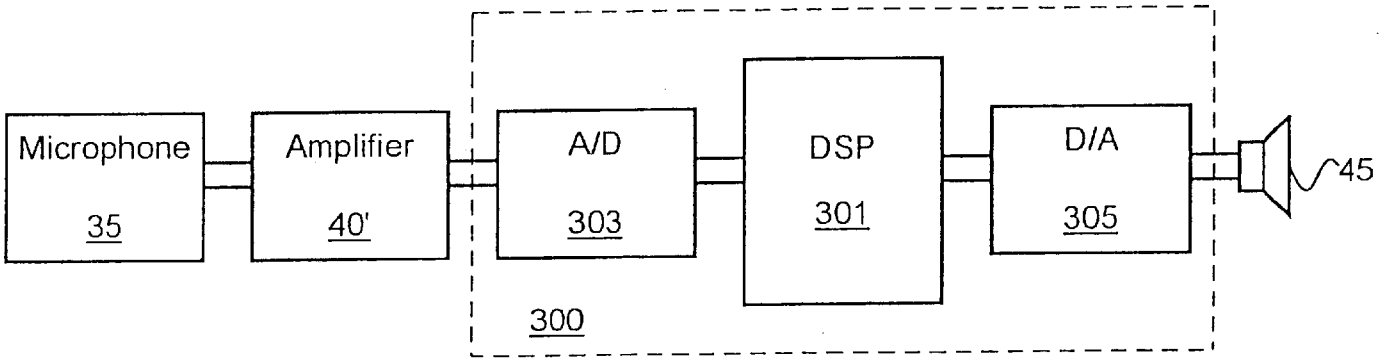

In the embodiment of FIG. 13A, the processing block 300 is interposed between the amplifier 40 and the earphone 45. In the embodiment of FIG. 13B, the processing block 300 is placed between the microphone 35 and the amplifier 40. In the embodiment of FIG. 13C, a further amplifier 40' is included that may, for example, function as a pre-amplifier. The processing block 300 is placed between the amplifier 40' and the amplifier 40 in FIG. 13C. In the embodiment of FIG. 13D, the processing block 300 is placed between the amplifier 40' and the earphone 45. In FIG. 13D, the amplification that is ordinarily performed by the amplifier 40 may be performed digitally by the DSP 301 itself. Finally, in the embodiment of FIG. 13E, the processing block 300 is placed directly between the microphone 35 and the earphone 45.

In each of the illustrated embodiments, the hearing aid components may be disposed within a single housing, such as, for example, one of those illustrated in FIGS. 4 and 5 above. In addition, in each of the illustrated embodiments, the D/A converter 305 functionality may be accomplished instead by the combination of the switched DSP output and the low pass filtering characteristics of the earphone 45.

In operation of the hearing aid of FIG. 13A, the microphone 35 detects sound from the exterior of the hearing aid and transduces the sound to produce electronic signals. The amplifier 40 amplifies these electronic signals to produce amplified electronic signals. As mentioned above with respect to FIGS. 2A–2C, the amplifier 40 may be constructed, for example, in accordance with the teachings of U.S. Pat. Nos. 4,170,720 or 4,689,819. Other amplifier circuits or components may also be used. The amplified signals are converted into digital signals by the A/D converter 303, and the digital signals are transmitted to the DSP 301. The DSP 301 then, in accordance with an application program, performs digital operations to, for example, smooth or damp the frequency response of the hearing aid (i.e., compensate for undamped peak(s) in such response), as discussed more completely above. The resulting digital signals are then converted into analog signals by the D/A converter 305, which are then converted into sound by the earphone or receiver 45 for transmission into the ear canal of a hearing aid user.

The operation of the hearing aid of FIG. 13B is similar to that of FIG. 13A, except that the digital damping is performed on the microphone 35 output signal before it is amplified by the amplifier 40.

The operation of the hearing aid of FIG. 13C is likewise similar to the operation of FIG. 13B, except that the signals from the output of the microphone 35 are amplified by the amplifier 40' before they are transmitted to the A/D converter 303.

The operation of the hearing aid of FIG. 13D is similar to the operation of FIG. 13C, except that the amplification performed by the amplifier 40 (FIG. 13C) is instead performed by the DSP 301 itself in FIG. 13D.

Figure 13E:
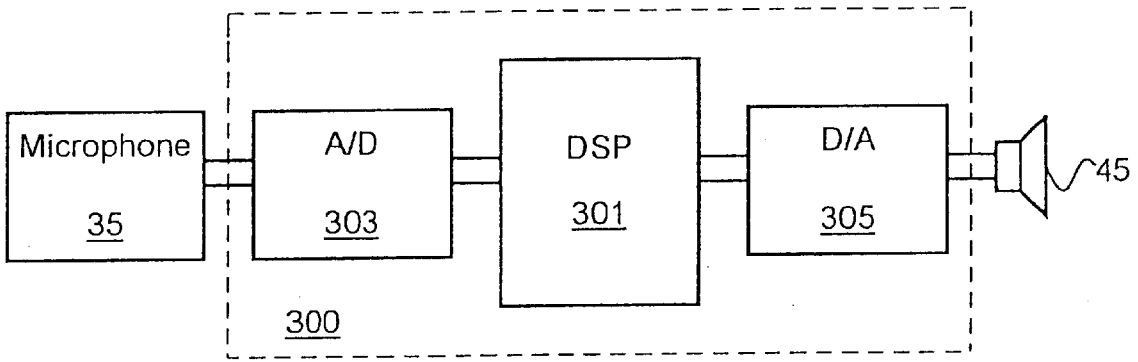

Finally, the operation of FIG. 13E is likewise similar to that of FIG. 13D, except that no pre-amplification is performed (i.e., no amplifier 40'). In other words, the electrical signals from the microphone 35 are transmitted directly into the A/D converter 303, which converts the electrical signals into digital signals. The digital signals are then fed into the DSP 301, which performs the damping and the desired amplification. The DSP 301 then transmits the damped and amplified digital signals to the D/A converter 305, which converts the digital signals to analog signals and transmits the analog signals to the earphone 45. The earphone 45 in turn converts the analog signals to sound for transmission into the ear canal of a hearing aid user.

Figure 14:
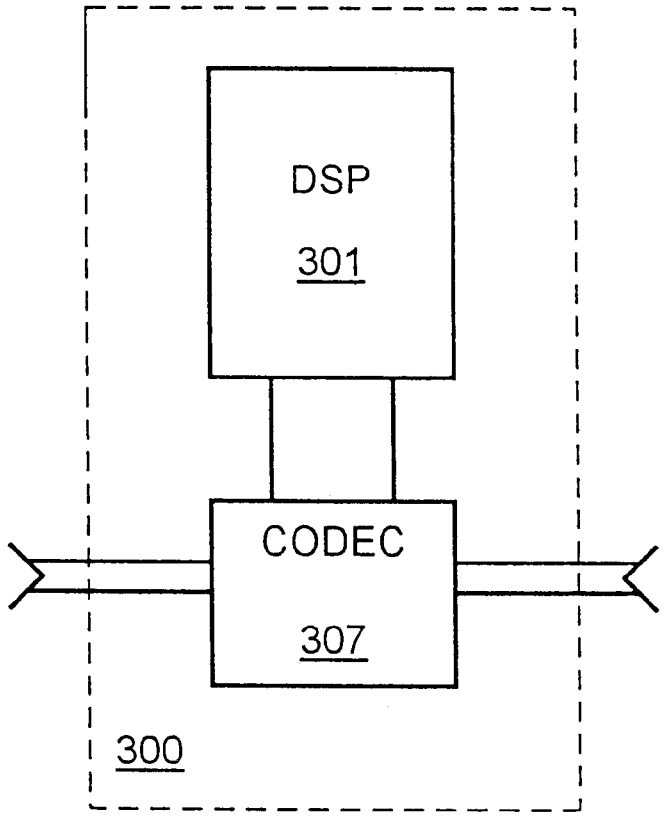
FIG. 14 is an alternate embodiment of a processing block set forth in the embodiments of a FIGS. 13A–13E.

FIG. 14 is an alternate embodiment of the processing block 300 set forth in FIGS. 13A–13E. As can be seen, the A/D converter 303 and D/A converter 305 are replaced by a single CODEC component 307, which performs both the analog to digital and digital to analog conversions. The CODEC component 307 is coupled to the DSP 301, and transmits digital signals to, and receives digital signals from, the DSP 301. This embodiment may be desirable to save space within the hearing aid.

Figure 15:
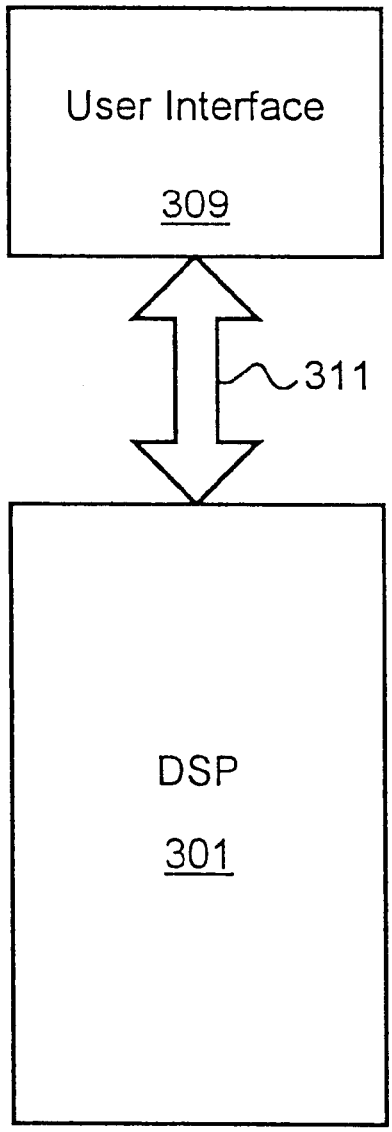
FIG. 15 illustrates a user interface that communicates with a digital signal processor of FIGS. 13A–13E and 14 for modifying damping characteristics of the digital signal processor.

As mentioned above, different hearing aid constructions may use different earphones (or microphones) having undamped peaks over different frequency ranges. FIG. 15 illustrates a user interface 309 that communicates with the DSP 301 via a communication link 311 for modifying the damping characteristics of the DSP 301. The user interface 309 may be, for example, a hearing aid programming device, a personal computer, a portable palm-type computer, or the like. The communication link 311 may be, for example, a serial-type communication link. In any case, a hearing aid programmer may utilize the user interface to modify the damping characteristics of the DSP 301 to fit the needs of different users wearing different hearing aid constructions.

Figure 16:
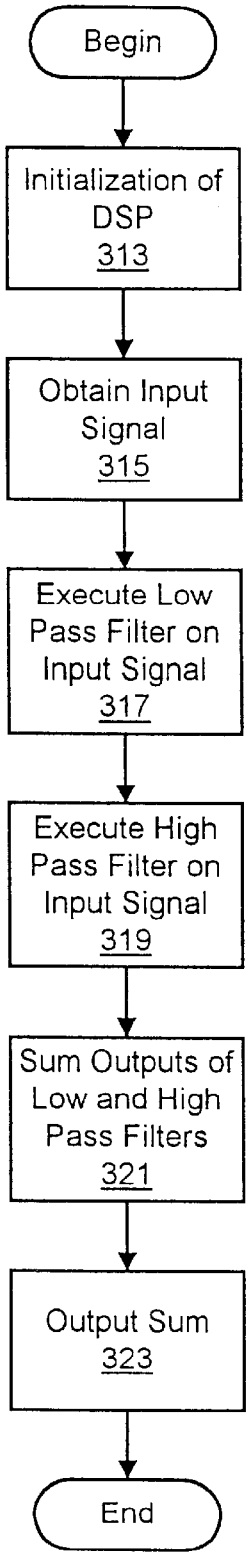
FIG. 16 is a flow diagram of one embodiment of the functionality of the digital signal processor for performing damping.

FIG. 16 is a flow diagram of one embodiment of the functionality of the DSP 301 for performing damping. First, the DSP is initialized (block 313). Initialization may involve, for example, the setting of coefficient parameters of one or more digital filters implemented by the DSP 301. This initialization may be done via, for example, the user interface discussed above with respect to FIG. 15.

Next, the DSP obtains a digital input signal from the A/D converter (or the CODEC component) (block 315). The DSP then executes a low pass filter on the input signal (block 317), executes a high pass filter on the input signal (block 319), and sums the outputs of the low and high pass filters (block 321). The resulting summed signal is then output to the D/A converter (or the CODEC component) (block 323). Of course, it should be understood that blocks 317 and 319 may be switched, such that the execution of the high pass filter occurs before the execution of the low pass filter.

Following this description and prior to the claims is an exemplary computer code listing (hereinafter referred to as "the Code") that represents one embodiment of code that may be used by the DSP 301 of the hearing aid of the present invention. The Code is being submitted as part of the specification pursuant to 37 C.F.R. §1.96(b)(2), and generally performs the functionality set forth above in FIG. 16.

In the embodiment set forth in the Code, the digital damper employs second order low pass and high pass filters. For one application where the sampling frequency, fs, is equal to 31254.4 Hz, the high pass and low pass filter coefficients may be as follows:

HPF bdhn2=−0.78222165976659 1.56444331953318 −0.78222165976659 adhn2=1.00000000000000 −1.41072275789474 0.71816388117161

LPF bdln2=−0.06441790976552 −0.12883581953103 −0.06441790976552 adln2=1.00000000000000 −1.40778665884544 0.66545829790751

Figure 17:
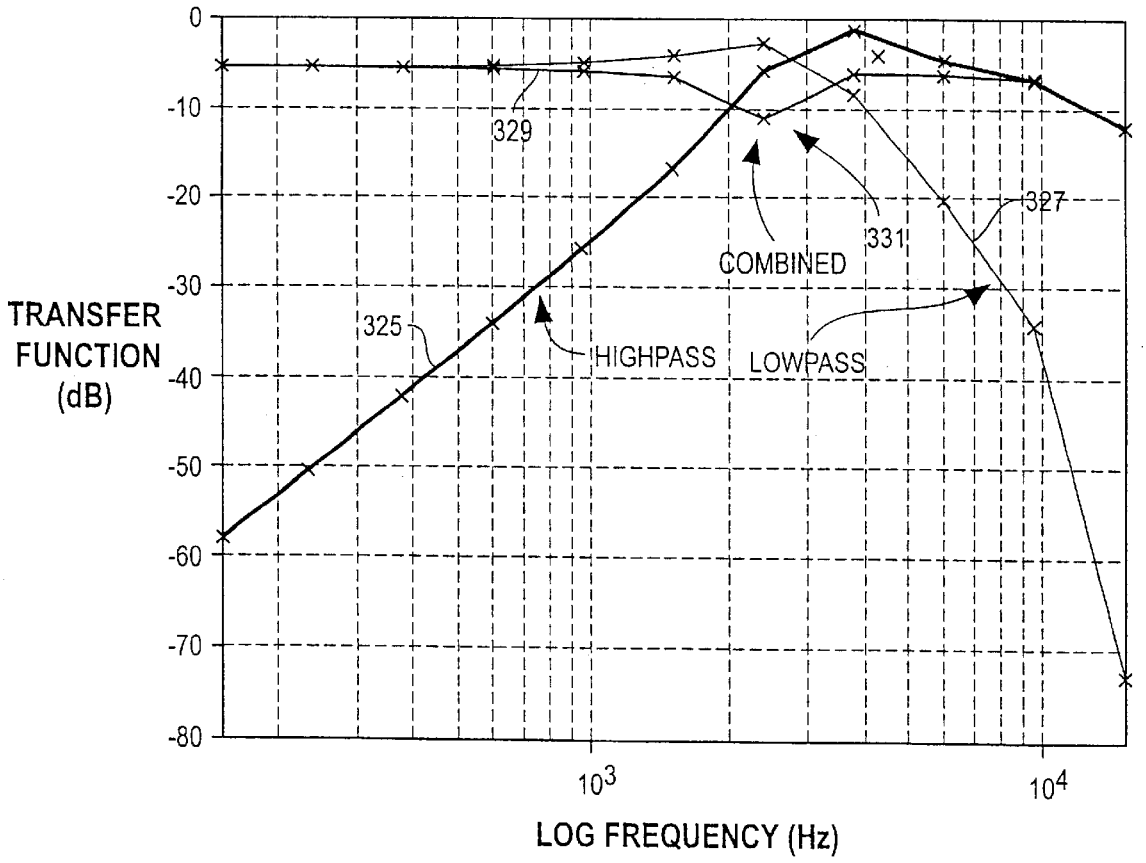
FIG. 17 is a graph of the measured response of one embodiment of the digital filter built in accordance with the present invention.

FIG. 17 is a graph of the measured response using the Code and the filter coefficients listed above. Curve 325 represents the output of the high pass filter, curve 327 represents the output of the low pass filter, and curve 329 represents the summation or combination of the outputs of the high and low pass filters.

Figure 18:
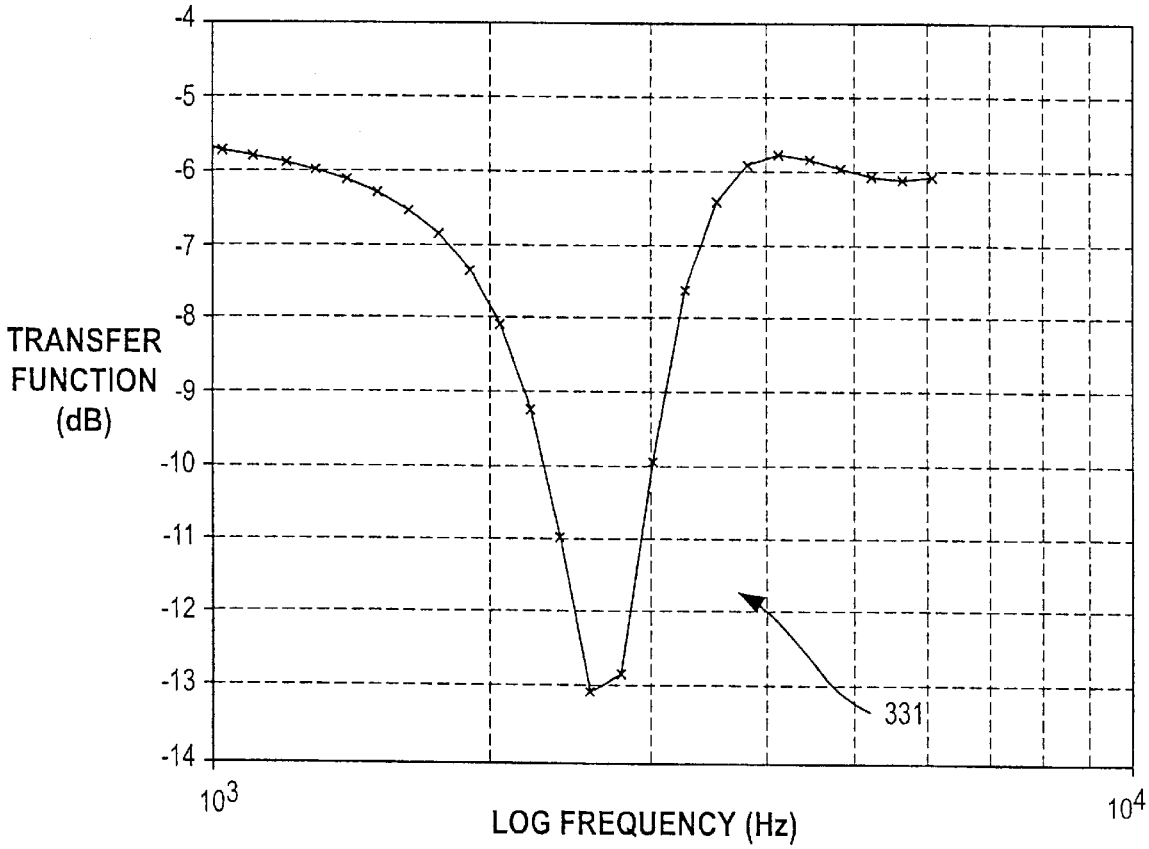
FIG. 18 is a graph illustrating a different view of a notch or inverse peak of the measured response of FIG. 17.

FIG. 18 is a graph illustrating an exploded view (i.e., on a different scale) of the notch or inverse peak found in curve 329 of FIG. 17. As discussed more completely above, this inverse peak generally compensates for an undamped peak in the hearing aid response that occurs across a frequency range within the audible hearing range.

Also as mentioned above, the filter coefficients in the Code may be modified to alter the shape, location and/or magnitude of the notch or inverse peak in accordance with the desired application. In addition, the sampling frequency may also be modified.

Although the present invention has been described with reference to specific embodiments, those of skill in the art will recognize that changes may be made thereto without departing from the scope and spirit of the invention as set forth in the appended claims.

Submission of Computer Program Listing as Part of the Specification Pursuant to 37 C.F.R. §1.96(b)(2)

```
        opt     mu,nocc,loc,mex
        include 'settings.asm'
        NOLIST
        include '..\common\ioequ.asm'
        include 'vectors.asm'
        LIST
;;;
```

-continued

```
=1 update output data)
;;;
```

-continued

```
        move    #Ames1,r1                       ; GO message
        jsr     screen
        move    x:M_SRXL,a                      ; dummy read to clear data
; disable device detection
        bclr    #0,x:Detect_Device
startup
        jsr     key_in
        jclr    #KEY_L,x:keypressed,aid2
        jclr    #KEY_R,x:keypressed,aid2
        jclr    #KEY_D,x:keypressed,aid2
        jsclr   #KEY_U,x:keypressed,power_off           ; turn power off
        jmp     startup
;;;
```

-continued

```
;
;       x (n) - - - - - - - > - | - > - - - b01 - - - (+) - > - - - - - - - - - - - - - - - > y(n)
;                               |                                   |
;                               |                                   |
;                             1/z                                 1/z
;                               | x(n-1)                            | y[n-1]
;                               v                                   v
;                               | - > - - - b11 - - > - | < - - a11 - < - |
;                               |                       |             |
;                               |                       |             |
;                             1/z                                 1/z
;                               | x(n-2)                            | y[n-2]
;                               v                                   v
;                               - - > - - - b21 - - > - | < - - a21 - - - <
;
; NOTES: All coefficients are divided by 2
;
;       X Memory Organization       Y Memory Organization
;                | y[n-2] |                |          |                | a21/2 |
;                | y[n-1] |                |          |
;                | x[n-2] |                | a11/2    |
;       R0 - >   | x[n-1] | Data           | b21/2    |
;                |        |                | b11/2    |
;                                   R4 - > | b01/2    | Coefficients
;
;
;     Input:x0 = input
;                                r0--> data in x
;                                r4 --> coef in y
;     Output:              a = filter output
;
;*****************************************************************************;
iir2df
            section iir2df
opt cc
            move                                x:(r0),x1           y:(r4)+,y0                  ;
x1=x[n−1], y0=b01
            ori                 #8,mr
                        ; turn on scaling mode
            mpy                 x0,y0,a         x0,x:(r0)+          y:(r4)+,y0                  ;
a = b01x[n], save next x[n−1], y0=b11
            mac                 x1,y0,a         x:(r0),x0           y:(r4)+,y1                  ;
a = b01x[n]+b11x[n−1], x0=x[n−2], y1=b21
            mac                 x0,y1,a         x1,x:(r0)+          y:(r4)+,y0                  ;
a = b01x[n]+b11x[n−1]+b21x[n−2], save next x[n−2], y0=a11
            move                                x:(r0)+,x1          y:(r4)+,y1                  ;
x1=y[n−1], y1=a21
            mac                 −y0,x1,ax:(r0),x0                                               ;
a=b01x[n]+b11x[n−1]+b21x[n−2]−a11y[n−1], x0=y[n−2]
            macr        −y1,x0,ax1,x:(r0)−                                                      ;
a=b01x[n]+b11x[n−1]+b21x[n−2]−a11y[n−1]−a21y[n−2], save next y[n−2]
            nop
            move                                a,x:(r0)                                        ;
save next y[n−1]
            rts
            endsec
;*****************************************************************************
            NOLIST
            include '..\common\keypad.asm'
            include 'codec.asm'
            include '..\common\lcd.asm'
            include '..\common\clock.asm'
            include '..\common\clock_rw.asm'
            include '..\common\clockptr.asm'
            include '..\common\dac.asm'
            include '..\common\comm1.asm'
digital damper second order LPF and HPF filter coefficients
fs=31254.4 Hz
HPF
bdhn2 =     −0.78222165976659     1.56444331953318     −0.78222165976659
adhn2 =      1.00000000000000    −1.41072275789474      0.71816388117161
```

-continued

| | | | |
|---|---|---|---|
| LPF | | | |
| bdln2 = | −0.06441790976552 | −0.12883581953103 | −0.06441790976552 |
| adln2 = | 1.00000000000000 | −1.40778665884544 | 0.66545829790751 |

What is claimed is:

1. A hearing aid comprising:

a. a housing having an interior and an exterior;

b. a microphone disposed in the interior of said housing and having at least one sound inlet tube to receive sound from the exterior of said housing;

c. a digital signal processor for damping signals representative of sound received by said microphone, said digital signal processor having a frequency response characterized by a generally flat portion and an inverse peak, said digital signal processor executing at least one filter for defining the inverse peak;

d. a programming interface for communicating with the digital signal processor; and e. an earphone for transducing signals that have been damped by said digital signal processor into sound representative of the sound received by said microphone, said earphone having a sound outlet tube for conducting sound to the exterior of said housing, said earphone having a frequency response including a generally flat portion and at least one undamped peak, said at least one undamped peak occurring over a frequency range that is at least partially dependent on the length of said outlet tube, said inverse peak of said digital signal processor occurring over a frequency range generally corresponding to the frequency range of said undamped peak thereby to provide a hearing aid output signal that is generally unaffected by undesirable characteristics of said undamped peak.

2. A hearing aid as claimed in claim 1 wherein said programming interface comprises a digital interface for accepting digital data for modifying filter characteristics of the digital signal processor.

3. A hearing aid as claimed in claim 2 wherein said filter characteristics comprise filter coefficients.

4. A hearing aid as claimed in claim 1 wherein said hearing aid output signal has a generally flat response across the frequency range of said undamped peak.

5. A hearing aid as claimed in claim 1 wherein said digital signal processor is responsive to communication received via said programming interface for shifting the frequency range of said inverse peak.

6. A hearing aid as claimed in claim 1 wherein said digital signal processor is responsive to communication received via said programming interface for altering the magnitude of said inverse peak.

7. A hearing aid as claimed in claim 1 wherein said at least one filter comprises a low pass filter and a high pass filter.

8. A hearing aid as claimed in claim 1 wherein said at least one filter is a second order filter.

9. A hearing aid as claimed in claim 1 and further comprising an amplifier connected to receive electrical signals from said microphone, and an analog to digital converter connected to receive amplified output signals from said amplifier and to provide digital signals to said digital signal processor.

10. A hearing aid as claimed in claim 9 and further comprising a digital to analog converter for receiving damped digital signals from said digital signal processor, and a further amplifier connected to receive damped analog signals from the digital to analog converter and for generating further amplified output signals for output to said earphone.

11. A hearing aid as claimed in claim 1 and further comprising a digital to analog converter for receiving damped digital signals from said digital signal processor, and an amplifier connected to receive damped analog signals from the digital to analog converter and for generating amplified output signals for output to said earphone.

12. A hearing aid comprising:

a. a microphone for transducing sound waves into electrical signals, said microphone having a frequency response including a generally flat portion and at least one undamped peak, said at least one undamped peak occurring over a frequency range;

b. a digital signal processor for damping said at least one undamped peak, said digital signal processor having a frequency response characterized by a generally flat portion and an inverse peak, said inverse peak occurring over a frequency range generally corresponding to the frequency range of said undamped peak thereby to provide an electrical signal that is generally unaffected by undesirable characteristics of said undamped peak, said digital signal processor executing at least one filter for defining the inverse peak;

c. a programming interface for varying filter characteristics of the at least one filter;

d. an earphone for transducing damped electrical hearing aid signals into sound representative of the sound received by said microphone; and e. a housing for housing at least the microphone and the digital signal processor, the housing being shaped to conform to an ear of a hearing aid wearer.

13. A hearing aid as claimed in claim 12 and further comprising an analog to digital converter and an amplifier connected to receive said electrical signals from said microphone, said amplifier generating amplified output signals that are supplied to the input of said analog to digital converter, said analog to digital converter supplying digital signals to said digital signal processor.

14. A hearing aid as claimed in claim 13 and further comprising a digital to analog converter for receiving damped digital signals from said digital signal processor, and a further amplifier connected to receive damped analog signals from the digital to analog converter and for generating further amplified output signals for output to said earphone.

15. A hearing aid as claimed in claim 12 and further comprising a digital to analog converter for receiving damped digital signals from said digital signal processor, and a amplifier connected to receive damped analog signals from the digital to analog converter and for generating amplified output signals for output to said earphone.

16. A hearing aid as claimed in claim 12 wherein said programming interface comprises a digital interface for accepting digital data for varying filter characteristics of said at least one filter.

17. A hearing aid as claimed in claim 12 wherein said filter characteristics comprise filter coefficients.

18. A hearing aid as claimed in claim 12 wherein said microphone comprises a microphone having at least one sound inlet tube, said at least one sound inlet tube having a length that at least partially determines the frequency range of said undamped peak of said microphone.

19. A hearing aid as claimed in claim 12 wherein said digital signal processor is responsive to a communication received via the programming interface to vary the frequency range of said inverse peak.

20. A hearing aid as claimed in claim 12 wherein said digital signal processor is responsive to a communication received via the programming interface to vary the magnitude of said inverse peak.

21. A hearing aid as claimed in claim 12 wherein said digital signal processor is responsive to a communication received via the programming interface to vary both the magnitude and frequency range of said inverse peak.

22. A hearing aid as claimed in claim 12 wherein said at least one filter comprises a low pass filter and a high pass filter.

23. A hearing aid as claimed in claim 22 wherein said high pass filter and said low pass filter are second order filters.

24. A hearing aid as claimed in claim 12 wherein said at least one filter is a second order filter.

25. A hearing aid comprising:

a. a hearing aid component having a frequency response including a generally flat portion and at least one undamped peak, said at least one undamped peak occurring over a frequency range;

b. a digital signal processor for damping undesirable frequency response characteristics resulting from the presence of said at least one undamped peak, said digital signal processor having a frequency response characterized by a generally flat portion and an inverse peak, said inverse peak occurring over a frequency range generally corresponding to the frequency range of said undamped peak, said digital signal processor executing at least one filter for defining the inverse peak;

c. a programming interface for varying the filter characteristics of the at least one filter; and d. a housing for housing at least the hearing aid component and the digital signal processor, the housing being shaped to conform to an ear of a hearing aid wearer.

26. A hearing aid as claimed in claim 25 wherein said programming interface comprises a digital interface for accepting digital data for varying the filter characteristics of the at least one filter.

27. A hearing aid as claimed in claim 25 wherein said inverse peak and said undamped peak are of generally equal but opposite shape and magnitude.

28. A hearing aid as claimed in claim 25 wherein said hearing aid component is a microphone having at least one sound inlet tube, said inverse peak and said at least one sound inlet tube having a length that at least partially determines the frequency range of said undamped peak of said microphone.

29. A hearing aid as claimed in claim 25 wherein said digital signal processor is responsive to the programming interface to alter the magnitude of said inverse peak.

30. A hearing aid as claimed in claim 25 wherein said digital signal processor is responsive to the programming interface to alter the magnitude of said inverse peak and shift the frequency range of said inverse peak.

31. A hearing aid as claimed in claim 25 wherein said at least one filter comprises a low pass filter and a high pass filter.

32. A hearing aid as claimed in claim 31 wherein said high pass filter and said low pass filter are second order filters.

33. A hearing aid as claimed in claim 25 wherein said at least one filter is a second order filter.

34. A hearing aid as claimed in claim 25 wherein said hearing aid component is an earphone.

35. A hearing aid as claimed in claim 25 wherein said hearing aid component is a microphone.

* * * * *